US008179323B2

(12) United States Patent
Shamblin et al.

(10) Patent No.: US 8,179,323 B2
(45) Date of Patent: May 15, 2012

(54) LOW COST INTEGRATED ANTENNA ASSEMBLY AND METHODS FOR FABRICATION THEREOF

(75) Inventors: Jeffrey Shamblin, San Marcos, CA (US); Laurent Desclos, San Diego, CA (US); Mark Krier, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 386 days.

(21) Appl. No.: 12/337,639

(22) Filed: Dec. 18, 2008

(65) Prior Publication Data

US 2009/0231206 A1 Sep. 17, 2009

Related U.S. Application Data

(60) Provisional application No. 61/037,298, filed on Mar. 17, 2008.

(51) Int. Cl.
*H01Q 1/38* (2006.01)

(52) U.S. Cl. ..... 343/700 MS; 343/702; 343/824; 343/893; 343/895; 235/462.45

(58) Field of Classification Search ..... 343/700 MS, 343/824, 829, 846, 853, 893, 702, 895; 235/462.45
See application file for complete search history.

(56) References Cited

U.S. PATENT DOCUMENTS

| | | | | |
|---|---|---|---|---|
| 6,010,771 | A * | 1/2000 | Isen et al. | 428/209 |
| 6,094,179 | A * | 7/2000 | Davidson | 343/895 |
| 6,396,444 | B1 * | 5/2002 | Goward et al. | 343/702 |
| 6,603,432 | B2 * | 8/2003 | Hill et al. | 343/702 |
| 6,822,609 | B2 * | 11/2004 | Mendolia et al. | 343/700 MS |
| 6,947,008 | B2 * | 9/2005 | Tillery et al. | 343/824 |
| 7,080,787 | B2 * | 7/2006 | Wulff et al. | 235/462.45 |
| 7,113,136 | B2 * | 9/2006 | Marx | 343/703 |
| 7,354,001 | B2 * | 4/2008 | Wulff et al. | 235/462.45 |
| 7,486,243 | B2 * | 2/2009 | Wulff et al. | 343/702 |
| 2002/0000940 | A1 * | 1/2002 | Moren et al. | 343/702 |

* cited by examiner

*Primary Examiner* — Douglas W Owens
*Assistant Examiner* — Chuc Tran
(74) *Attorney, Agent, or Firm* — Costal Patent Agency

(57) ABSTRACT

A conductive layer is applied to a thermoformed plastic component to form an integrated antenna assembly. The conductive layer is on a flexible layer and adhered or attached to the rigid thermoformed plastic carrier. Features are designed into the thermoformed plastic carrier to provide electrical contacts from the conductive layer to the circuit board of the communication device and to mechanically attach the carrier to the circuit board. Multiple conductive layers can be applied to a multi-layered thermoformed structure to form a multi-antenna assembly.

16 Claims, 9 Drawing Sheets

LOW COST INTEGRATED ANTENNA ASSEMBLY AND METHODS FOR FABRICATION THEREOF

CROSS-REFERENCE TO RELATED APPLICATIONS

This application claims benefit of priority of U.S. Provisional Application Ser. No. 61/037,278 titled "Methods for Forming Antennas Using Thermoforming" filed Mar. 17, 2008, the contents of which are hereby incorporated by reference.

FIELD OF INVENTION

The present invention relates generally to the field of wireless communication. In particular, the present invention relates to antennas and methods for fabricating antennas for use in wireless communications.

BACKGROUND OF THE INVENTION

With the proliferation of wireless products and services, device manufacturers are forced to aggressively pursue cost reduction opportunities in the manufacturing and assembly of wireless device components. Reduction of costs associated with wireless antennas may thus be an important factor in staying competitive. Implementation of a cost-effective antenna may become even more critical as new features and functionalities are added to wireless devices that require more sophisticated antennas.

An internal antenna for a wireless device is typically manufactured as either a stamped metal element or as a flex-circuit antenna on a plastic carrier. Both techniques suffer from a high cost of production. The stamped metal element and the plastic carrier both require expensive and time consuming tooling for high volume production. Furthermore, while the flex-circuit antenna may be readily fabricated using a standard etching process, this technique is not suited for high-volume and cost-efficient production needs.

SUMMARY OF THE INVENTION

It is the goal of the various embodiments of the present invention to provide methods of forming cost effective and reliable wireless antennas. In one aspect of the present invention, a method for forming an antenna comprises the steps of; pre-forming a carrier element by thermoforming a non-conductive sheet material into a three-dimensional configuration; providing the pre-formed carrier element, a dielectric thin-sheet material, and a conductive material; applying the conductive material to the thin-sheet material to form a conductive layer on the thin-sheet material; and attaching the thin-sheet material to at least one surface of the pre-formed carrier element. The resulting assembly is an integrated antenna and carrier ready for assembly into a wireless device or other communication system. In a preferred embodiment, the carrier element can be pre-formed by using a vacuum forming process to form a non-conductive sheet material into a three-dimensional carrier element.

In one embodiment of the present invention, the conductive layer can comprise a conductive ink, for example a silver ink. Alternatively, the conductive layer can comprise one or more deposited metals, one or more conductive films, or any other conductive material. The conductive layer formed on a thin-sheet material can be referred to as an antenna element.

In another embodiment, the dielectric thin-sheet material can be stretchable, bendable, or flexible. The antenna element on the flexible sheet can be placed on the top surface of the thermoformed carrier element. This results in the conductive element on the outer surface of the integrated antenna assembly.

In another embodiment, the antenna element on the flexible sheet is placed on the bottom surface of the thermoformed carrier element. This provides a more cosmetic finish and mechanical protection for the conductive layer.

In yet another embodiment, the antenna element can be placed on both the top and bottom surfaces of the carrier element.

In another embodiment, the applying of the conductive layer comprises at least one of a printing, depositing, or placing of the conductive material on at least one surface of the dielectric thin-sheet material. In one embodiment, the printing is conducted in accordance with a stencil printer. According to another embodiment, the carrier sheet comprises a plastic sheet. In yet another embodiment, the forming produces a plurality of three-dimensional carrier elements that are separated into individual carrier element structures with a cutting apparatus.

In another embodiment, multiple antenna elements, each on flexible sheets can be stacked on a thermoformed carrier to form a multi-antenna assembly. In another embodiment, multiple thermoformed carriers, each with an antenna element on a flexible sheet attached thereto, can be stacked to form a multi-antenna assembly.

In another embodiment, multiple thermoformed carriers for the same or different antenna functions are combined in the same assembly. Antenna elements of the same or differing design and function are applied to the thermoformed carriers to complete a multi-antenna suite for a communication device.

In another embodiment, the thermoformed carriers are fabricated in sheet form, with carriers formed in a one or two dimensional array. In another embodiment, the thermoformed carriers are formed using a tape and reel method, where single or multiple carriers in columns are thermoformed and placed into a reel. The antennas on flexible thin-sheets are attached to the thermoformed carriers subsequent to fabrication of the carriers.

Another aspect of the present invention is the method of forming one or more raised areas on the edge of the thermoformed carrier for making contact with the circuit board. Feed and/or ground connections for the antenna element wrap around the edge of the thermoformed carrier, with the raised area providing pressure contact with the feed and ground pads on the circuit board of the communication device.

Another aspect of the present invention is a thermoformed plastic carrier with an opening cut or etched into a portion of the carrier. A conductive layer is wrapped around the edge of the opening, with the conductive layer on both upper and lower surfaces of the carrier. This assembly can be positioned between two thermoformed antenna assemblies and used to make electrical connection between the thermoformed antennas.

In another embodiment, bumps are formed on the plastic sheet at the desired locations of the feed and ground points of the antenna. Positive pressure contact is made between the feed and ground bumps and the circuit board.

In another embodiment, metal clips are used to connect the feed and ground locations on the thermoformed antenna to plated-thru holes on the circuit board. In another embodiment, a conductive pad on the circuit board can replace the plated-thru hole.

Another aspect of the present invention relates to an antenna comprising a non-conductive portion, a conductive portion, and one or more protrusions for connecting at least one of a ground and an electrical feed associated with the antenna to a circuit board. The antenna is fabricated by pre-forming a carrier element using a thermoforming, or preferably a vacuum forming process; providing the pre-formed carrier element, a dielectric thin-sheet material, and a conductive material; applying the conductive material to the thin-sheet material to form a conductive layer on the thin-sheet material; and attaching the thin-sheet material to at least one surface of the pre-formed carrier element.

Those skilled in the art will appreciate that various embodiments discussed above, or parts thereof, may be combined in a variety of ways to create further embodiments that are encompassed by the present invention.

DETAILED DESCRIPTION OF THE PREFERRED EMBODIMENTS

Figure 1:
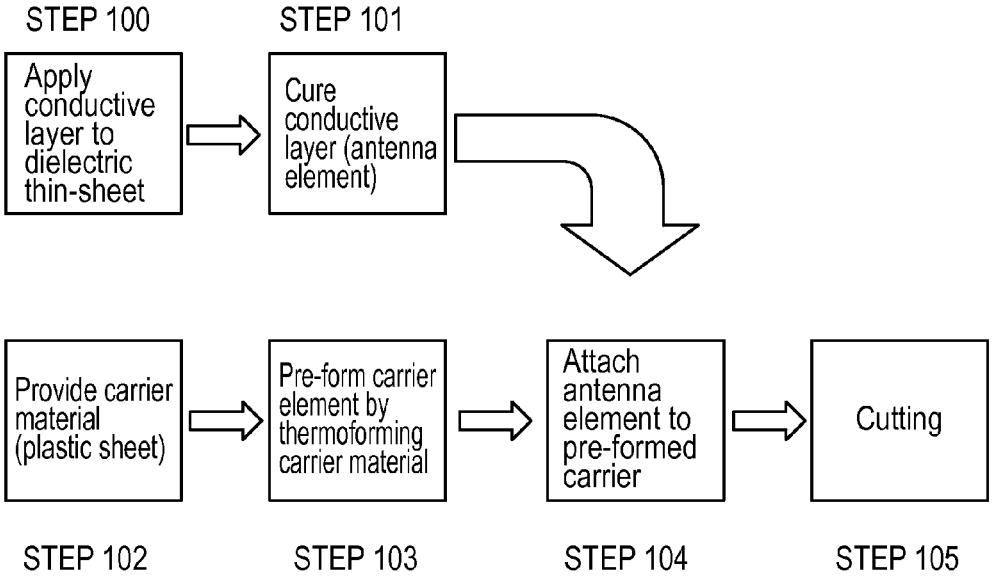
FIG. 1 illustrates an exemplary flow diagram in accordance with an example embodiment of the present invention.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

The antennas and methods described in accordance with embodiments of the present invention reduce the number of components in a wireless antenna to a as few as two components, and thus significantly reduce the complexity and costs associated with antenna fabrication. Embodiments of the invention achieve this goal by manufacturing cost-effective antenna structures using a thermoforming process. Thermoforming may refer to the process of forming a thermoplastic sheet into a three-dimensional shape by clamping the sheet in a frame, heating it to render it soft and pliable, then applying differential pressure to make the sheet conform to the shape of a mold, cast or die positioned below the frame. When pressure is applied entirely by vacuum, the process is called 'vacuum forming'.

In accordance with the various embodiments of the present invention, in parallel with vacuum forming the carrier, a conductive antenna pattern may be printed, deposited, or placed (hereinafter, collectively referred to as 'applied') on a dielectric thin-sheet. The thin sheet can be a plastic sheet or other non-conductive carrier material. The thin sheet will have a material thickness between about 0.0001 inches and about 0.0500 inches, and more preferably between about 0.0001 inches and about 0.0200 inches. The thin sheet can be bendable, flexible, stretchable, or any combination thereof. The conductive antenna pattern may be applied to one or both sides of the thermoformed plastic carrier. In some applications, however, it may be advantageous to use the plastic carrier as a protective layer by applying the antenna pattern to the bottom of the plastic carrier. This configuration, which may also provide an enhanced cosmetic appearance, can be used to implement an integrated contact point between the antenna terminals and the circuit board of the wireless device. Once the conductive material is applied to the vacuum formed plastic carrier, a low cost antenna assembly is created. A laser or other cutting mechanism may be used to subsequently cut out individual finished antenna structures that are now ready to be integrated into various communication devices.

The conductive pattern may be applied using a variety of techniques, including, but not limited to, printing conductive (e.g., silver) inks, placing or attaching conductive sheets such as copper or aluminum sheets, or depositing copper or other conductive materials on the plastic sheet using electro-deposition or similar techniques. The conductive material may be any one of silver, copper, aluminum, gold, or other conductive elements or composites. In one embodiment, the antenna pattern may be cut, punched, or etched onto the conductive material prior to its application to the plastic sheet. It should also be noted that the choice of non-conductive material is not limited to plastic, and it may comprise any material that can be formed by the thermoforming process. The conductive element, or plurality thereof, can be attached to the thermoformed carrier element by an attachment means such as a glue, adhesive, melt bond, chemical bond, solvent bond, or mechanical fit such as a friction fit.

FIG. 1 illustrates a flow diagram of an antenna forming process in accordance with an exemplary embodiment of the present invention. In Step 100 this exemplary embodiment involves applying conductive ink to a dielectric thin-sheet (an example would be silver ink applied on a 0.003 inch thick Mylar® or other polyester film) that is then cured in Step 101 to form the antenna element. An antenna element can be cured using a reflow oven or other drying system to cure the conductive ink. Step 102 includes providing the carrier material, which may comprise a non-conductive material such as plastic. However, as noted earlier, the carrier may include any suitable material other than plastic that can be utilized in the thermoforming process. The carrier material, herein referred to as a thermoformable carrier material, will have a melting temperature ($T_m$) between about 50.0° C. and about 500.0°

C., and preferably between about 50.0° C. and about 300.0° C. The carrier material will have a relaxed state at temperatures below 50.0° C., and will be rigid in the relaxed state. In Step 104, the antenna is attached to the thermoformed plastic carrier with an adhesive. Furthermore, depending on the antenna design specifications and preferences, the conductive pattern may be adhered to one or both sides of the thermoformed carrier. Finally, in Step 105 the thermoformed antennas are cut into individual antenna assemblies that can be incorporated into wireless devices or other communication systems. The cutting (Step 105) may be carried out using a laser cutter or other cutting apparatus. In one example embodiment, the plurality of thermoformed antennas may reside in a two-dimensional array and are subsequently separated or cut out to form the individual antennas.

Figure 2:
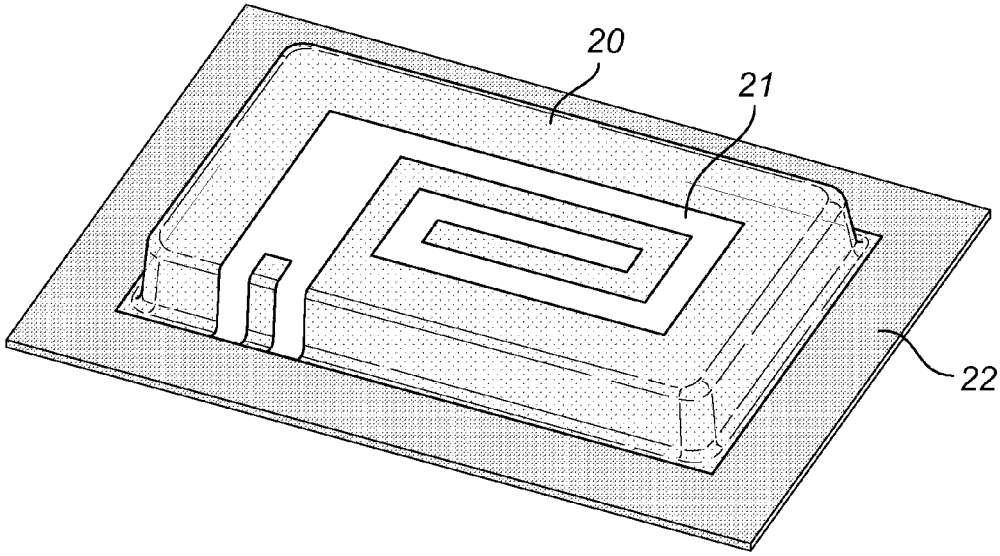
FIG. 2 illustrates an integrated antenna assembly comprising a conductive antenna element attached to the top side of a thermo-formed plastic carrier.

FIG. 2 shows an antenna that may be formed in accordance with an exemplary embodiment of the present invention. The exemplary antenna of FIG. 2 comprises an external conductive pattern 21, and is formed by adhering the conductive material to the top of the plastic carrier 20. The combination thermoformed carrier 20 and conductive pattern 21 are attached by various methods to the PCB22.

Figure 3:
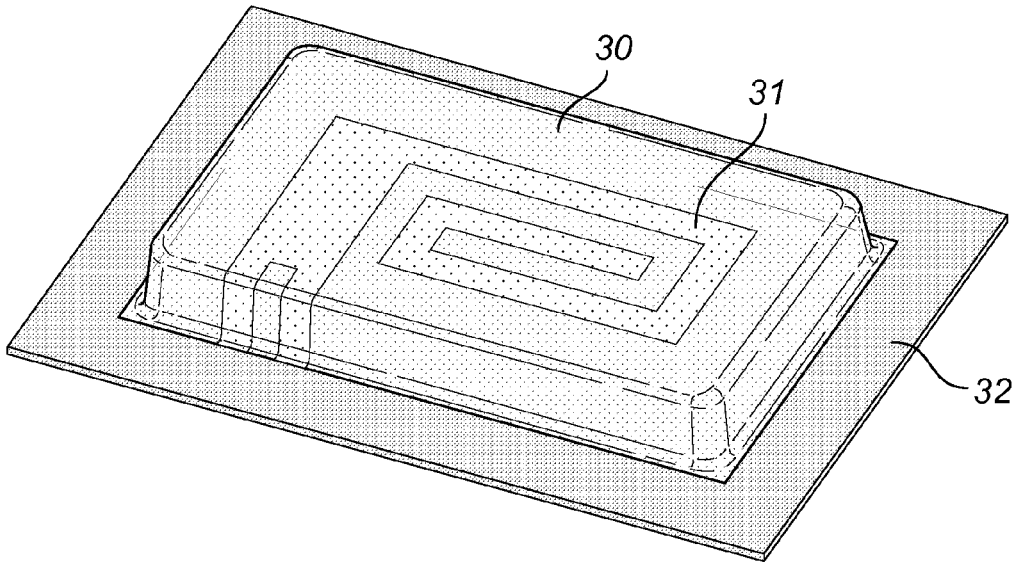
FIG. 3 illustrates an integrated antenna assembly comprising a conductive antenna element attached to the bottom side of a thermo-formed plastic carrier.

FIG. 3 shows an antenna that may be formed in accordance with an exemplary embodiment of the present invention. The exemplary antenna of FIG. 3 comprises an internal conductive pattern 31, and is formed by adhering the conductive material to the bottom of the thermoformed carrier 30. The combination thermoformed carrier 30 and conductive pattern 31 are attached by various methods to the PCB 32. These various methods will be described in detail below.

Figure 4:
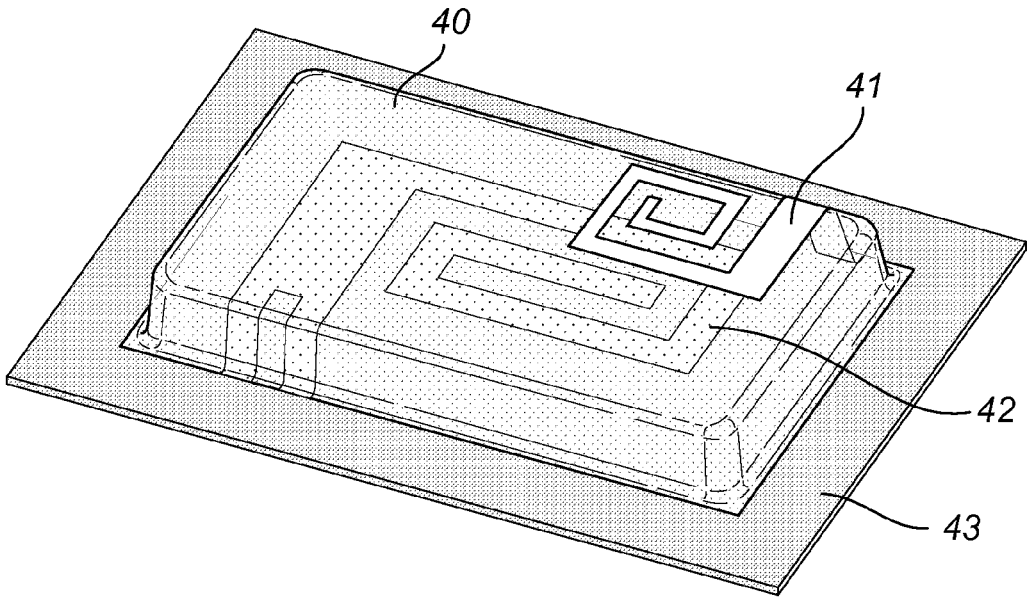
FIG. 4 illustrates an integrated antenna assembly comprising a conductive antenna elements attached to both the top and bottom side of a thermo-formed plastic carrier.

FIG. 4 shows antennas that may be formed in accordance with an exemplary embodiment of the present invention. The exemplary antennas of FIG. 4 comprise external conductive patterns 41 and 42, and are formed by adhering the conductive patterns 41 and 42 to both the top and bottom of the plastic carrier 40. The combination thermoformed carrier 40 and conductive patterns 41 and 42 are attached by various methods to the PCB43.

Figure 5:
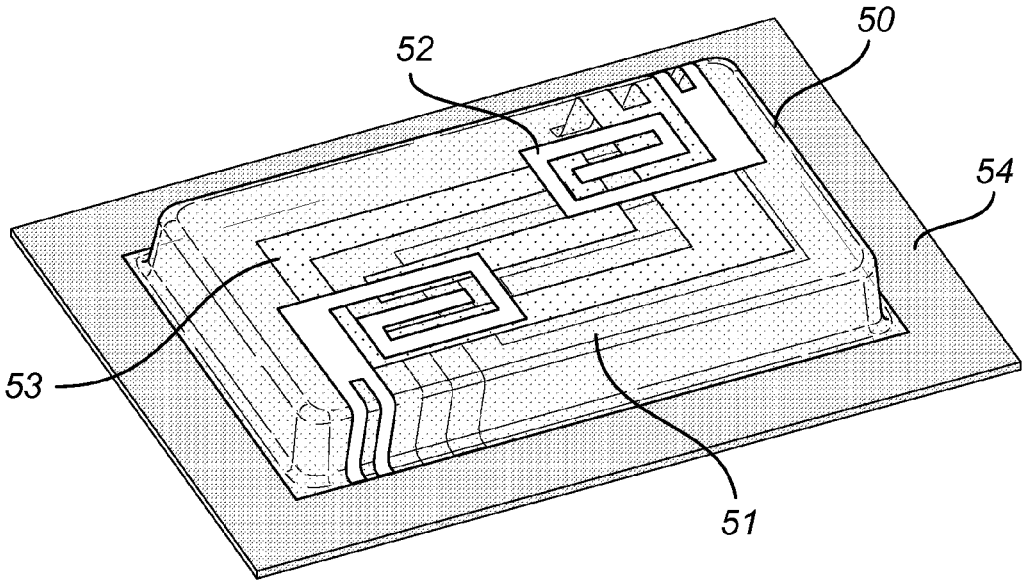
FIG. 5 illustrates an integrated antenna assembly comprising two thermo-formed plastic carriers, one on top of the other, with conductive antenna elements attached to both the top and bottom side of each thermo-formed plastic carrier.

FIG. 5 shows an integrated antenna assembly consisting two thermo-formed plastic carriers 50 and 51, one on top of the other, with conductive antenna elements 52 and 53 attached to both the top and bottom side of each thermoformed plastic carrier. The combination thermoformed carriers 50 and 51, and conductive patterns 52 and 53 are attached by various method to the PCB54.

Figure 6:
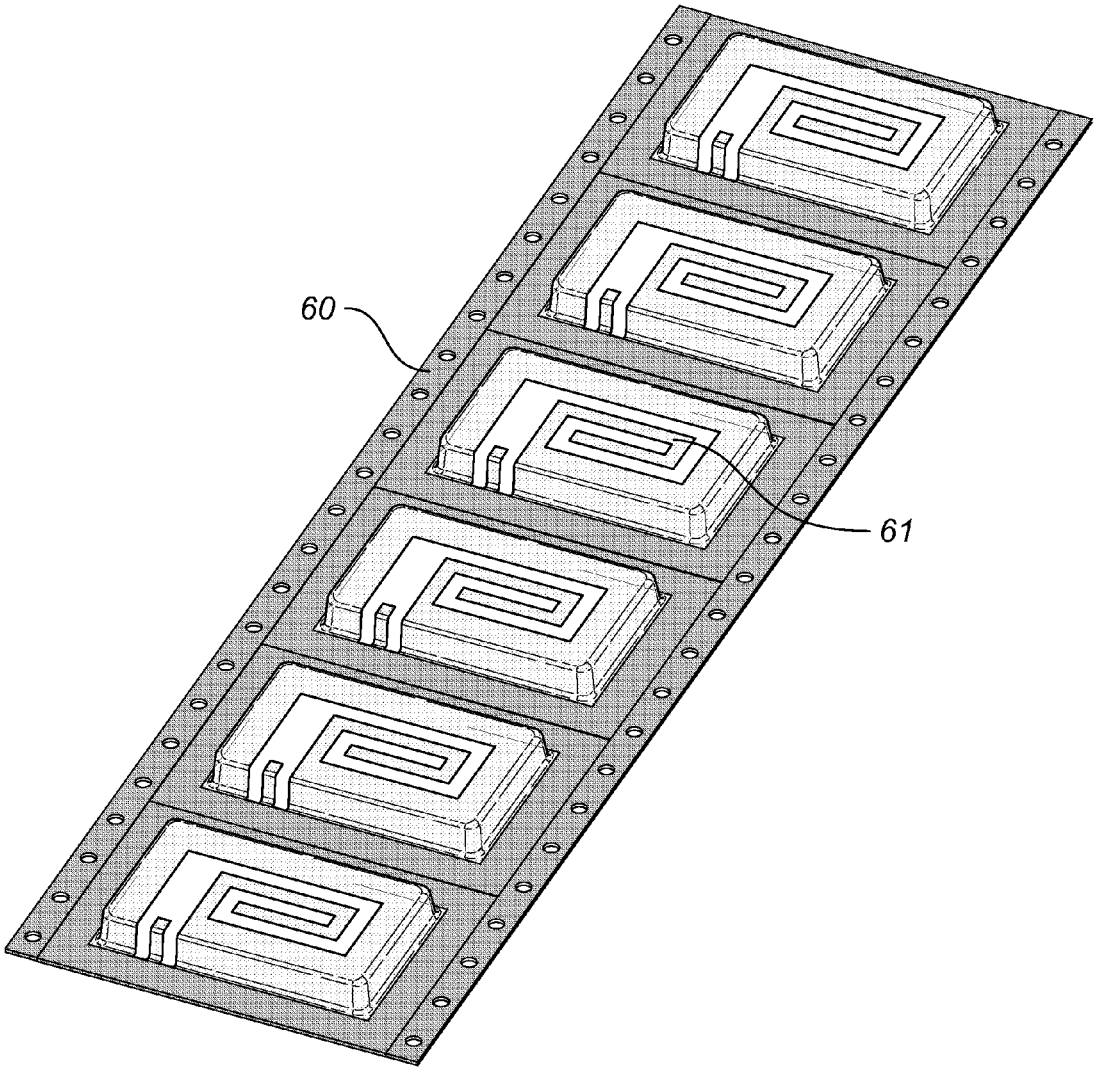
FIG. 6 illustrates thermoformed integrated antenna assemblies manufactured by tape and reel techniques.

In another embodiment of the present invention, tape-and-reel packaging techniques may be adapted to enable manufacturing of low cost integrated antennas. Tape-and-reel packaging comprises a carrier 'tape' with formed cavities for holding the SMD (surface mount device) components. FIG. 6 illustrates an exemplary tape 60 with a plurality of formed cavities 61. For example, A tape-and-reel package may accommodate up to several hundred thousand components that may be used by pick-and-place machines for automated assembly of electronic circuit boards.

Figure 7A:
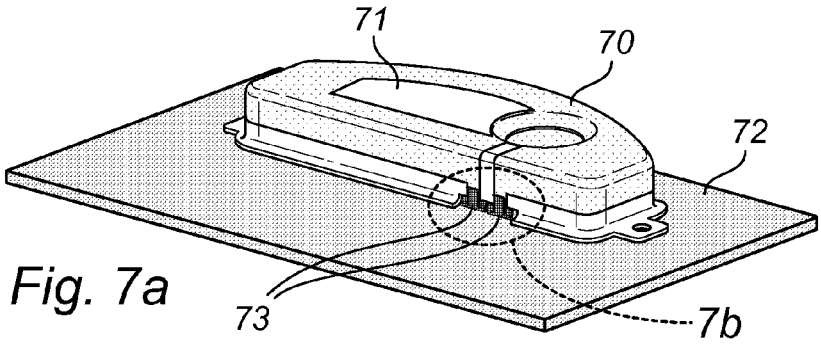
FIG. 7 illustrates contact clips used to establish an electrical connection between the feed and ground point of the conductive antenna element attached to the thermoformed carrier and the circuit board of the wireless system.
Figure 7C:
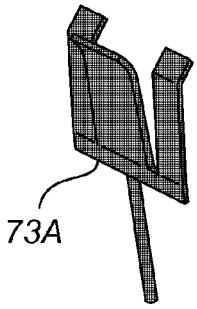
Figure 7B:
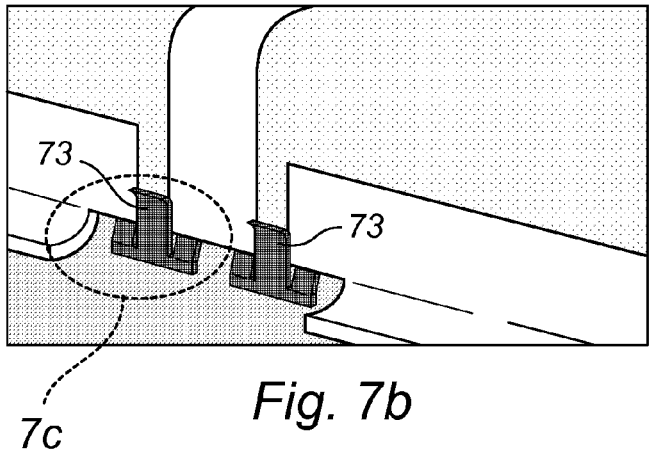

In accordance with another embodiment of the present invention, metal clips are used to provide a connection between the antenna feed and/or ground locations of the thermoformed antenna and the circuit board. FIGS. 7*a-c* illustrate an exemplary embodiment comprising a thermoformed antenna 70 that is placed on a PCB 72. The exemplary antenna 70 has an external conductive pattern 71 and one or more metallic contact clips 73 that connect the antenna feed and/or ground to the PCB 72. The thermoformed antenna can comprise a thermoformable anchoring element, such as a contact slot 74 for engagement with a contact clip 73. As shown in FIG. 7*b*, the contact slot can comprise one or more depressed channels which are thermoformed into the dielectric carrier prior to attachment of the conductive layer. The contact force is determined by the dimensions of the clip and the thickness of the antenna walls. The exemplary contact clip of FIG. 7*c* comprises a stem 73A that is designed to fit into a plated through hole of the PCB 72. In an alternate embodiment, a contact clip with no stem (or a smaller stem) may be utilized that allows electrical contact between a conductive pad on the PCB 72 and the contact clip 73. Soldering or a conductive epoxy can be used to maintain contact between the contact clip and pad on the circuit board.

Figure 8A:
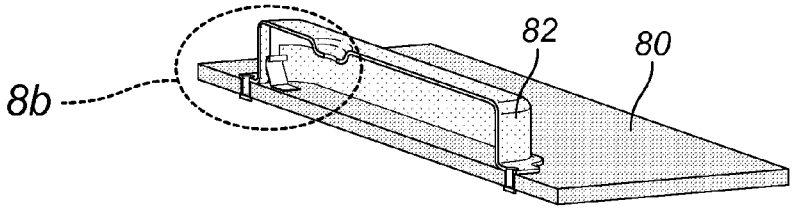
FIG. 8 illustrates the use of a contact spring to make electrical connection between the feed and/or ground point of the conductive element and the circuit board of the wireless system.
Figure 8B:
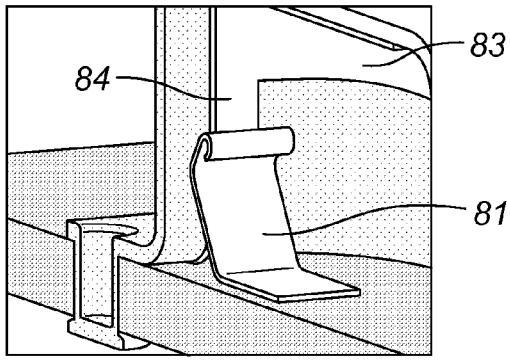
Figure 8C:
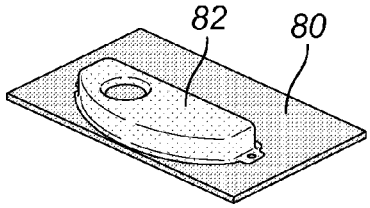

In accordance with another embodiment of the present invention, electrical contact between the feed and/or ground locations of an antenna with a circuit board may be achieved using a contact spring 81. FIGS. 8*a-c* illustrate an exemplary embodiment comprising a thermoformed antenna 82 that is connected to a PCB 80. The thermoformed antenna can comprise a thermoformable anchoring element, such as a contact groove. The contact groove 84 can comprise a depressed channel, an elevated channel, or a flat contact surface thermoformed into the dielectric carrier for attachment of the conductive layer. The conductive layer can be integrated into the contact groove 84, for a flush surface finish. The contact spring 81 can engage the contact groove 84 to complete a circuit. The exemplary antenna 82 has an internal conductive pattern 83 and one or more contact springs 81 that connect the feed and/ground on the internal antenna pattern to the PCB 80.

Figure 9A:
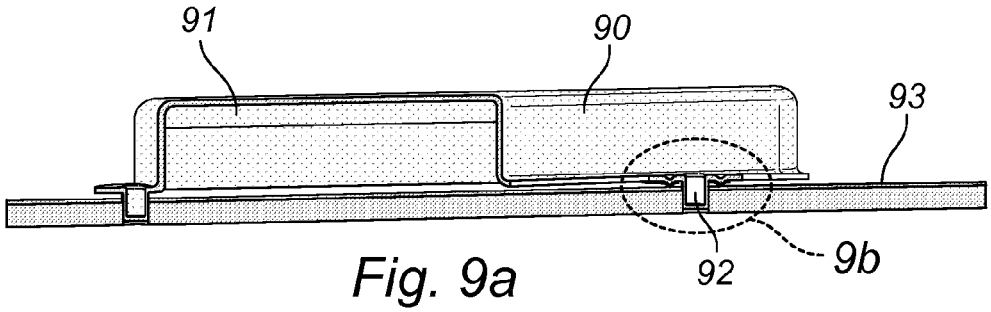
FIG. 9 illustrates integrated contact bumps used to establish an electrical connection between the feed and/or ground point of the conductive element and the circuit board of the wireless system.
Figure 9B:
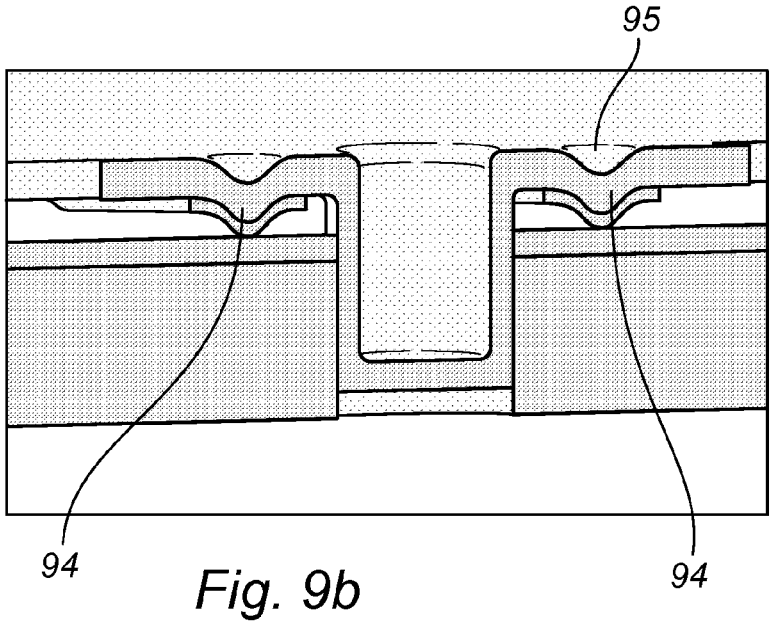

In accordance with another embodiment of the present invention, integrated contact bumps are implemented for providing electrical connection between the feed and/or ground point of the thermoformed antenna and the circuit board of the communication system. FIGS. 9*a-b*, in accordance with an exemplary embodiment of the present invention, illustrate a PCB 93, and a thermoformed antenna 90 that comprises an internal conductive pattern 91, one or more heat stacking pins 92, and one or more integrated contact bumps 94. The one or more integrated bumps 94 are situated close to one or more heat stacking pins 92, and comprise a dielectric notch 95 formed in a thermoforming process. The integrated bumps 94 act as 'springs,' and are situated at desired locations to allow positive contact pressure to apply between the feed and ground points of the antenna and the appropriate locations on the PCB 93. The thermoformed antenna can comprise a thermoformable anchoring element, such as the thermoformed dielectric notch 95. A thermoformed dielectric notch 95 can be thermoformed into the dielectric carrier prior to attachment of the conductive layer. The thermoformed notch 94 can be configured to engage a heat stacking pin 92 having a thermoformed dielectric notch 95 aligned with the integrated contact bump 94. The contact force is a function of the plastic wall thickness and the dimensions of the bump.

Figure 10:
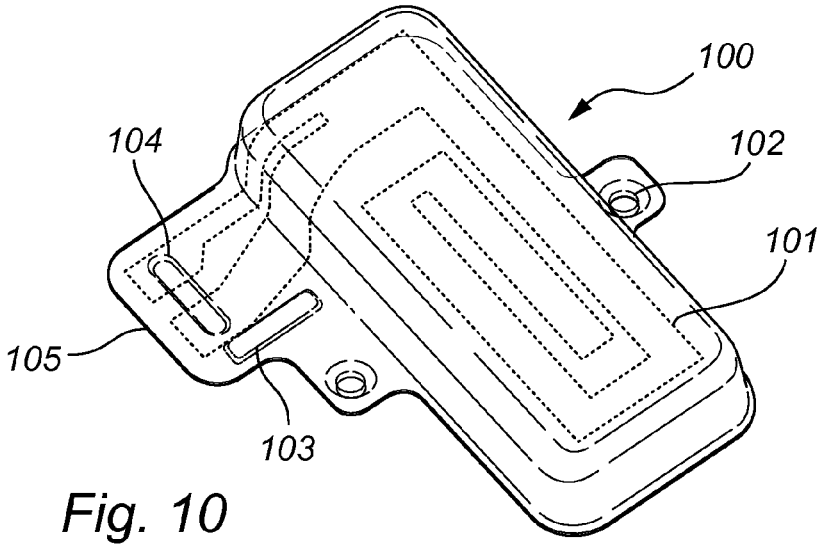
FIG. 10 illustrates heat stack pins which attach the thermoformed carrier to the circuit board. An embossed region is formed in the feed point region to provide rigidity to assist in applying pressure to feed legs.

In accordance with another embodiment of the present invention, the dielectric thermoformed carrier can comprise an embossed or depressed region 105 formed into the thermoformed carrier to assist in providing positive pressure for electrical connection between antenna feed and/or ground legs and the contacts on the circuit. FIG. 10, in accordance with an exemplary embodiment of the present invention, illustrates a PCB, and a thermoformed antenna 100 that comprises an internal conductive pattern 101, one or more heat stacking pins 102, and one or more integrated contact bumps 103. The heat stacking pins are not located close to the integrated contact bump, so an additional integrated contact bump 104 is placed perpendicular to the contact bump that intersects the silver ink pattern, to assist in providing positive contact pressure between the feed and ground points on the antenna and the appropriate locations on the PCB. In an alternative embodiment, one or more screws can be used to provide pressure between the feed and ground points on the antenna and the appropriate locations on the PCB. In another embodiment, one or more screws can be used in combination with one or more heat stacking pins.

Figure 11:
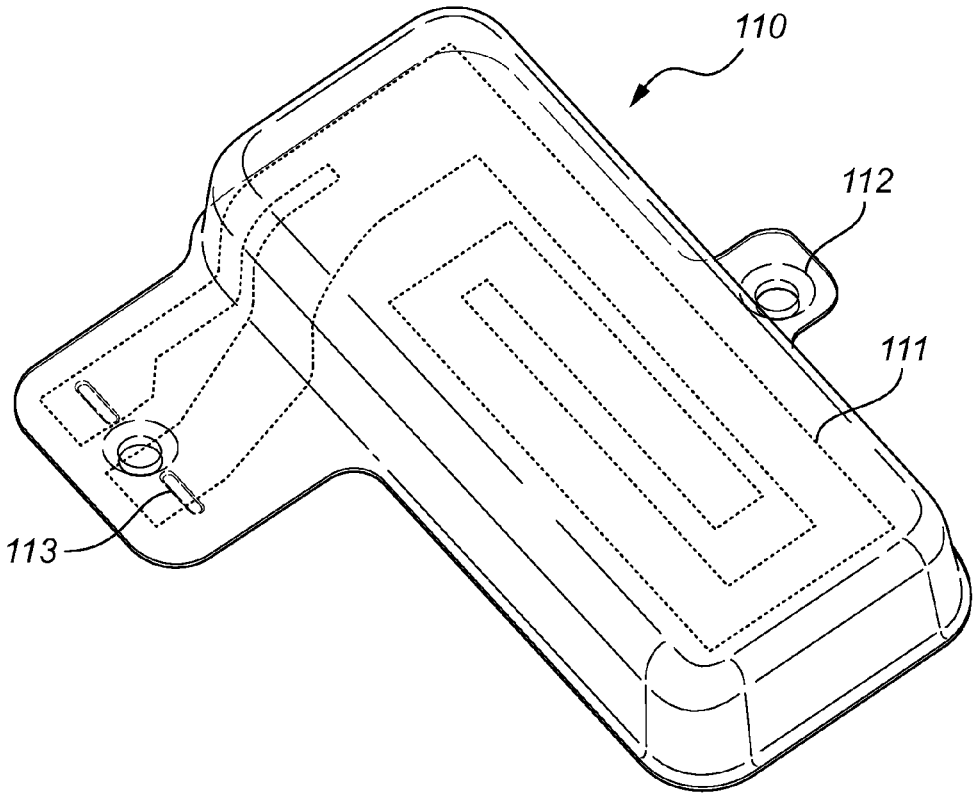
FIG. 11 illustrates heat stack pins which attach the thermoformed carrier to the circuit and to apply pressure to the feed legs for electrical connection.

In accordance with another embodiment of the present invention, FIG. 11, illustrates a PCB, and a thermoformed antenna 110 that comprises an internal conductive pattern 111, one or more heat stacking pins 112, and one or more integrated contact bumps 113. One of the heat stacking pins is located in close proximity to the integrated contact bump, to assist in providing positive contact pressure between the feed and ground points on the antenna and the appropriate locations on the PCB.

While particular embodiments of the present invention have been disclosed, it is to be understood that various modifications and combinations are possible and are contemplated within the true spirit and scope of the appended claims. There is no intention, therefore, of limitations to the exact abstract and disclosure herein presented.

What is claimed is:

1. A method for fabrication of an integrated antenna assembly, comprising;

thermoforming a plastic carrier element to yield a three-dimensional configuration adapted to fit within a communication wireless device, said plastic carrier element having a top surface and a bottom surface thereof, providing a first dielectric thin-sheet material, and a first conductive material; applying the first conductive material to the first dielectric thin-sheet material to form a first conductive layer; providing a second dielectric thin-sheet material, and a second conductive material; applying said second conductive material to said second dielectric thin-sheet material to form a second conductive layer; and attaching said first and second conductive layers to at least one of said top surface or said bottom surface of said plastic carrier element.

2. The method of claim 1, wherein said first conductive material and said second conductive material are independently selected from the group consisting of: a conductive ink, a conductive sheet, a conductive film, and a deposited metal.

3. The method of claim 1, wherein said applying comprises at least one of a printing, depositing, or placing of said conductive material on at least one surface of said first and second dielectric thin-sheet materials.

4. The method of claim 1, wherein at least one of said dielectric thin-sheet materials comprises a thickness between about 0.0001 inches and about 0.020 inches.

5. The method of claim 1, wherein at least one of said dielectric thin-sheet materials comprises a $T_m$ between about 50.0° C. and about 300.0° C.

6. The method of claim 1, wherein said attaching comprises at least one of, gluing, affixing, adhering, bonding, or mechanically combining said first and second conductive layers to said plastic carrier element.

7. The method of claim 1, wherein multiple antenna elements are individually stacked between two or more dielectric layers to form a multi-antenna assembly.

8. The method of claim 1, comprising:

thermoforming a plurality of plastic carriers in an array, and;

applying a separate conductive layer to each of said plastic carriers of said array.

9. The method of claim 8, wherein said plurality of plastic carriers are attached to said conductive layers using a tape and reel apparatus.

10. An integrated antenna assembly for use in a wireless communication device, comprising: a thermoformed plastic carrier comprising at least one anchoring element for anchoring said plastic carrier to a PCB board; a first conductive element applied to a first dielectric thin-sheet material to form a first conductive layer; a second conductive element applied to a second dielectric thin-sheet material to form a second conductive layer; and said first and second conductive layers each being attached to the plastic carrier on at least one surface thereof; wherein said antenna comprises a plurality of conductive elements being individually disposed between two or more dielectric layers.

11. The antenna assembly of claim 10, wherein said thermoformed plastic carrier comprises a $T_m$ between about 50.0° C. and about 300.0° C.

12. The antenna assembly of claim 11, wherein said first and second conductive layers are each attached to said plastic carrier by at least one of: a glue, adhesive, solvent bond, melt bond, or friction fitting.

13. The antenna assembly of claim 10, wherein said anchoring element is attached to said PCB board by at least one of a contact clip, contact spring, screw, or a heat stacking pin.

14. The antenna assembly of claim 13, wherein said anchoring element is a contact slot, wherein said contact slot is adapted to engage said contact clip.

15. The antenna assembly of claim 13, wherein said anchoring element is a contact groove, wherein said contact groove is adapted to engage said contact spring.

16. The antenna assembly of claim 13, wherein said anchoring element is an integrated bump, wherein said integrated bump is adapted to engage said heat stacking pin.

* * * * *